United States Patent [19]

Egnaczak et al.

[11] Patent Number: 4,458,590

[45] Date of Patent: Jul. 10, 1984

[54] PRINTING PRESS WITH PLATE CYLINDER SKEW AND THROW OFF

[75] Inventors: Kenneth A. Egnaczak, Oneco, Conn.; Glenn A. Guaraldi, Wood River Junction, R.I.

[73] Assignee: Harris Graphics Corporation, Melbourne, Fla.

[21] Appl. No.: 431,009

[22] Filed: Sep. 30, 1982

[51] Int. Cl.[3] ..... B41F 13/28; B41F 13/38

[52] U.S. Cl. ..... 101/247; 101/218

[58] Field of Search ..... 101/218, 247, 248

[56] References Cited

U.S. PATENT DOCUMENTS

| | | | |
|---|---|---|---|
| 1,798,974 | 3/1931 | Corse | 101/218 |
| 2,568,761 | 9/1951 | Peyrebrune | 101/218 |
| 2,874,636 | 2/1959 | Royer et al. | 101/218 |
| 2,986,086 | 5/1961 | Siebke | 101/218 |
| 3,072,050 | 1/1963 | Wolff | 101/221 |
| 3,163,110 | 12/1964 | Thompson | 101/247 |
| 3,183,297 | 1/1980 | Skiera | 101/220 |
| 3,323,452 | 6/1967 | Pasquinelli | 101/218 |
| 3,470,816 | 10/1969 | Piecha et al. | 101/218 |

FOREIGN PATENT DOCUMENTS

| | | | |
|---|---|---|---|
| 1295604 | 11/1972 | United Kingdom | 101/218 |

*Primary Examiner*—William Pieprz

*Attorney, Agent, or Firm*—Yount & Tarolli

[57] ABSTRACT

A printing press comprises a frame. A plate cylinder is mounted in the frame for rotation about a first axis and a blanket cylinder is mounted in the frame for rotation about a second axis. The plate cylinder and the blanket cylinder have a contact pressure therebetween for printing operation. A skew eccentric is supported by the frame and is associated with at least one end of the plate cylinder. The skew eccentric is operable to change the relative angular positions of said first and second axes. A means is connected with said skew eccentric for maintaining the contact pressure between the plate cylinder and the blanket cylinder substantially unchanged upon rotation of the skew eccentric.

13 Claims, 8 Drawing Figures

PRINTING PRESS WITH PLATE CYLINDER SKEW AND THROW OFF

BACKGROUND OF THE INVENTION

The present invention relates to a printing press, and in particular the present invention relates to an offset printing press in which a plate cylinder is mounted for skew and throw off movement relative to a cooperating blanket cylinder.

A conventional offset printing press includes two printing couples. Each printing couple includes a plate cylinder and a blanket cylinder. The plate cylinder is disposed in rolling engagement with the blanket cylinder and transfers an ink impression onto the blanket cylinder. The blanket cylinder in turn transfers the ink to the material being printed. The second printing couple includes a second plate cylinder and a second blanket cylinder which prints on a second side of the material at the same time that the first blanket cylinder prints on a first side of the material. This type of press is known as a perfecting press.

It has been common practice to mount at least one cylinder of each printing couple of a perfecting press in eccentrics for the purpose of throw-off and throw-on of the cylinders relative to each other. Also, it is common practice to mount a plate cylinder in a skew eccentric for skewing the plate cylinder relative to the blanket cylinder. Also, in an offset perfecting press it is known to mount a plate cylinder in eccentrics to skew the cylinder relative to a blanket cylinder and to throw off the plate cylinder. See U.S. Pat. No. 3,633,503.

In the prior art when the plate cylinder is skewed, the skew eccentric is turned causing the axis of rotation of the plate cylinder to skew with respect to the blanket cylinder axis. When skewing occurs the distance between the centers of the plate and blanket cylinders changes. This can result in an undesired change in the printing pressure, particularly if a relatively large amount of skew is desired.

SUMMARY OF THE INVENTION

The present invention provides an offset printing press in which the plate cylinder is mounted for adjustment in a manner that substantially maintains the contact pressure between the plate cylinder and the blanket cylinder when the plate cylinder is skewed, and even if a relatively large amount of skew occurs. Specifically, the plate cylinder skew and throw off mechanisms are associated in such a manner that upon skew of the plate cylinder the throw off mechanism functions to minimize the change in the center distance between the plate and blanket cylinder.

In a preferred embodiment, the plate cylinder has throw-off eccentrics and a separate skew eccentric. A linkage rotates the plate cylinder throw off eccentrics. When the skew eccentric for the plate cylinder is rotated, the linkage causes the plate cylinder throw off eccentric to be rotated by a small amount in a direction which tends to compensate for the change in contact pressure which would otherwise be caused by rotation of the skew eccentric. Specifically, the linkage rotates the throw off eccentric in response to movement of the skew eccentric to cause the plate cylinder axis to travel along a path which is approximately tangent to the blanket cylinder. This minimizes movement of the plate cylinder away from the blanket cylinder upon actuation of the skew eccentric to an extent sufficient to make readjustment of the contact pressure unnecessary upon actuation of the skew eccentric.

BRIEF DESCRIPTION OF THE DRAWINGS

These and other features of the present invention will become apparent to those skilled in the art upon reading the following detailed description of the invention with reference to the accompanying drawings in which.

DESCRIPTION OF PREFERRED EMBODIMENT

As noted above, the present invention relates to an offset printing press. The press includes a plate cylinder which may be skewed relative to a cooperating blanket cylinder and which also may be thrown off the cooperating blanket cylinder. The press is constructed so that skew adjustment of the plate cylinder does not substantially change the distance between the centers of the plate and blanket cylinders.

Figure 1:
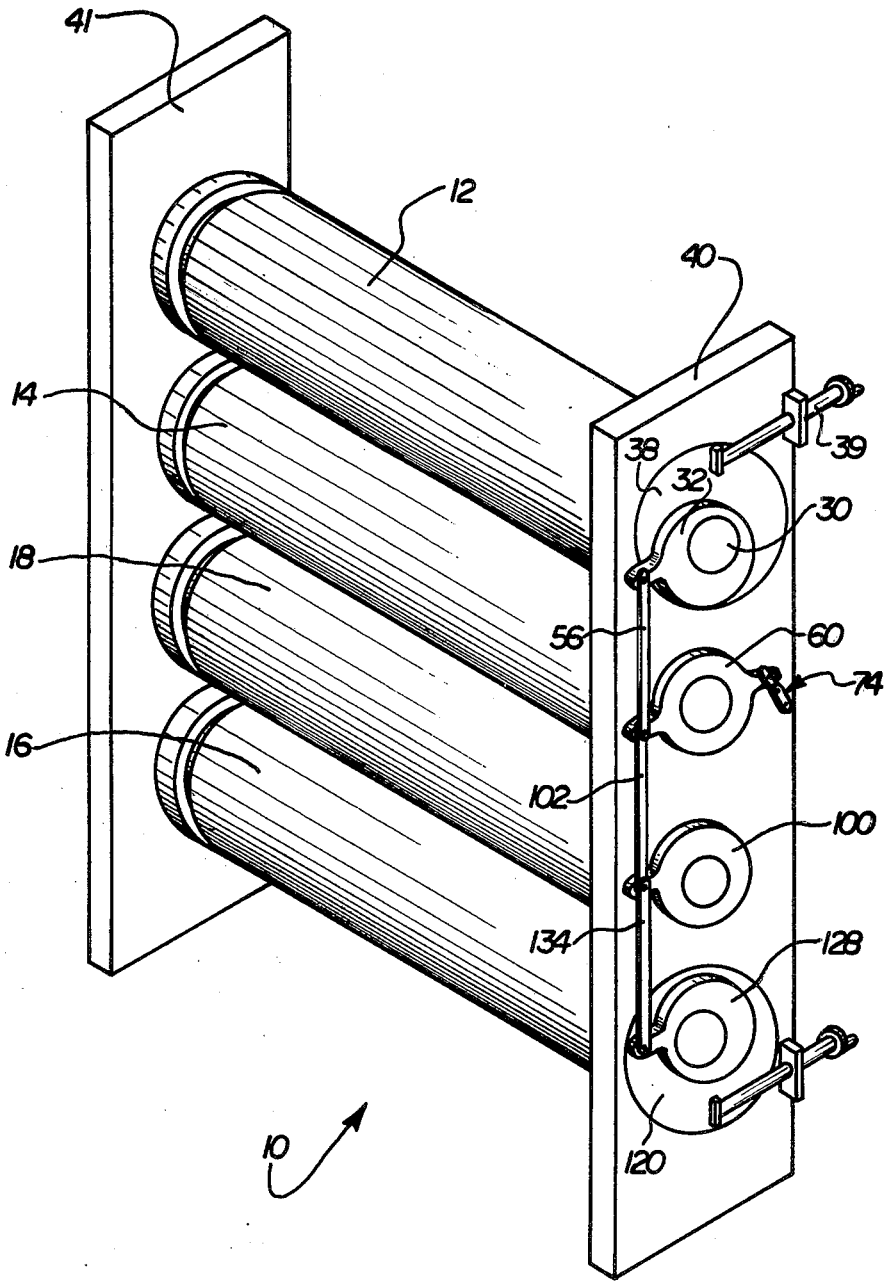
FIG. 1 is a schematic perspective view of a printing press constructed in accordance with the present invention.
Figure 2:
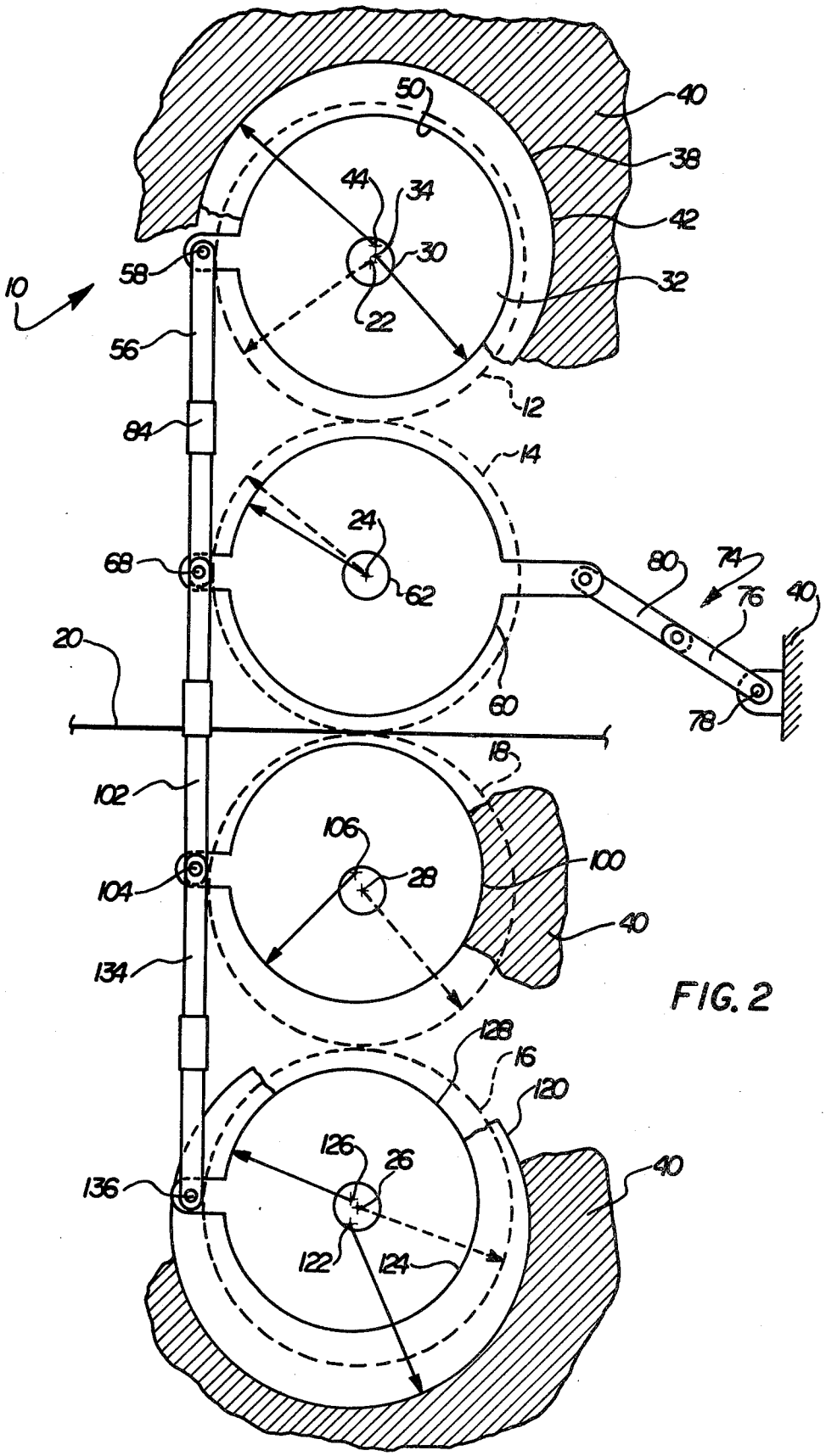
FIG. 2 schematically illustrates a portion of the press of FIG. 1.

FIG. 1 schematically illustrates a printing press 10 constructed in accordance with the present invention. The printing press 10 is an offset lithographic perfecting press. The press 10 includes a plate cylinder 12, a blanket cylinder 14 cooperating with the plate cylinder 12, a plate cylinder 16, and a blanket cylinder 18 cooperating with the plate cylinder 16. Suitable inkers and dampeners (not shown) are associated with the plate cylinders as are known. Material to be printed such as a web 20 (FIG. 2) is fed between the blanket cylinders 14 and 18. The cylinders 12, 14, 16, and 18 are rotatable about axes 22, 24, 26 and 28, respectively (see FIG. 2). In the illustrated embodiment, the axes 22, 24, 26 and 28 lie in substantially the same vertical plane when the cylinders are printing.

Plate cylinder 12 (FIG. 1) includes a stub shaft 30 extending from one end portion thereof. The stub shaft 30 is rotatably supported in a throw off eccentric 32. A similar stub shaft (not shown) extends from the opposite end portion of the plate cylinder 12 and is also supported by a throw off eccentric (not shown). Upon rotation of the throw off eccentric 32 and its axially opposite counterpart, the plate cylinder 12 moves along an arcuate path centered on axis 34, the center of eccentric 32 (see FIG. 2). When the throw off eccentric 32 is rotated in a clockwise direction as viewed in FIG. 2, the plate cylinder 12 moves away from the blanket cylinder 14 and thus is thrown out of engagement with the blanket cylinder 14.

The plate cylinder 12 is also supported in a skewing eccentric 38 which is rotatably mounted in the side frame member 40 of the printing press 10. The skewing eccentric 38 includes a cylindrical outside surface 42 (FIG. 2) which is received in a corresponding opening in the frame 40. The outside surface 42 of the skew eccentric 38 is centered about axis 44. The skew eccentric further includes a cylindrical inside surface 50 centered about axis 34 and which rotatably receives the throw off eccentric 32. As shown in the FIG. 1, a portion of the eccentric 32 projects axially beyond the eccentric 38. Preferably, the opposite end of the plate cylinder 12 is not mounted in a skew eccentric but rather is mounted in a suitable bearing.

The printing press 10 also includes conventional means for rotating the skew eccentric 38 to effect movement of the plate cylinder to change the relative angular position of the plate cylinder 12 and of the blanket cylinder 14. Such means may be a rod 39 connected to the skew eccentric and threaded into a portion of the frame so that on rotation of the rod it moves axially to rotate the eccentric. To avoid prolixity of description the means for rotating the skew eccentric 38 will not be described further, for the same would be obvious to one of ordinary skill in the art.

From the above, it will be clear that the skew eccentric 38 is rotatably supported by the side frame member 40 and in turn supports the throw off eccentric 32 which in turn supports the stub shaft 30 of the plate cylinder 12.

The throw off eccentric 32 is rotated by means of a link 56 (FIG. 2) which has one portion pivotally connected with the throw off eccentric 32 by a pin 58 to effect pivoting of the throw off eccentric in the cylindrical bore 50 when the link 56 moves vertically. This causes the axis 22 of the plate cylinder 12 to move along an arc centered about axis 34 and thus the plate cylinder moves away from or toward the blanket cylinder 14 depending upon the direction of rotation of the eccentric 32.

The link 56 is pivotally connected with a concentric bearing 60 which supports stub shaft 62 which is coaxial with and forms a part of the blanket cylinder 14. The link 56 is pivotally connected to the bearing 60 by a pin 68 in such a manner that it changes its vertical position when the bearing 60 is rotated. A similar concentric bearing (not shown) supports the opposite end of the blanket cylinder 14 in the side frame member 41.

A toggle mechanism 74 is provided to cause the concentric bearing 60 to rotate about the axis 24 of the stub shaft 62. The toggle mechanism 74 includes a link 76 which is fixed to shaft 78 and a link 80 pivotably connected between link 76 and concentric bearing 60. Upon pivoting of shaft 80, the toggle mechanism 74 operates to move the link 56 up or down with the results described above.

The link 56 is adjustable in length to vary the distance between the axis of the plate cylinder 12 and the axis of the blanket cylinder 14. This has the effect of varying the contact pressure at the bearers of the press (not shown) and/or between the plate cylinder 12 and blanket cylinder 14 when they are in a thrown on position, i.e., in contact with each other. To effect the lengthwise adjustment of link 56, the link is provided with a turnbuckle 84, but other types of mechanisms could be used. A similar linkage appears on the opposite side of the press.

The blanket cylinder 18 is also mounted in a pair of eccentrics. The eccentric 100 is mounted in side frame member 40, and a corresponding eccentric (not shown) is mounted in side frame member 41. The eccentric 100 is connected by an adjustable length link 102 with the concentric bearing support 60. The link 102 is pivotally connected with the bearing 60 and the link 56 by the pin 68. The link 102 is pivotally connected to the eccentric 100 by a pin 104 to effect rotation of the eccentric 100. When the eccentric 100 is rotated, the center 28 of the blanket cylinder 18 pivots along an arc centered about axis 106 which is the center of the cylindrical outside surface of the eccentric 100. A corresponding linkage (not shown) located on the opposite side of the press operates the corresponding eccentric supporting the opposite end of the blanket cylinder 18. Thus, rotation of eccentric 100 effects separation of the blanket cylinder 18 from the blanket cylinder 14.

The plate cylinder 16 is mounted in eccentrics in a manner similar to the manner in which the plate cylinder 12 is mounted in eccentrics. Thus, the plate cylinder 16 is mounted in a skew eccentric 120 which has a cylindrical outside surface centered on axis 122 which is rotatably received in the side frame member 40. The skew eccentric 120 also has a cylindrical inside surface 124 centered about axis 126 which rotatably receives a throw off eccentric 128.

The throw off eccentric 128 is connected by an adjustable length link 134 with the throw off eccentric 100 which mounts blanket cylinder 18. The adjustable length link 134 is pivotably connected with eccentric 100 by the pin 104 and is also pivotally connected by a pin 136 to the throw off eccentric 128. The opposite end of the plate cylinder 16 is supported by a throw off eccentric (not shown) rotatably mounted in the side frame member 41, and is actuated by a similar linkage.

Figure 3:
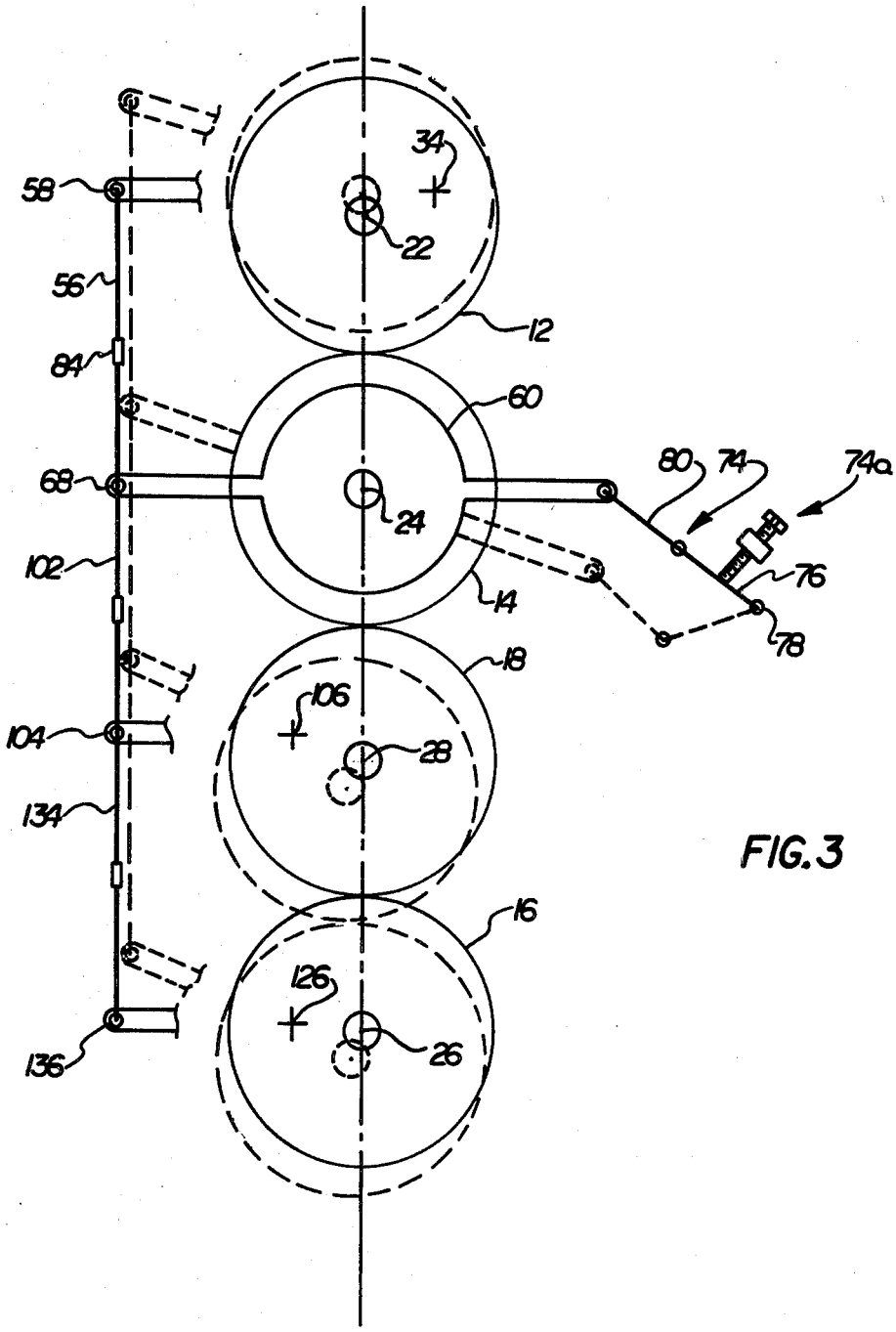
FIG. 3 is a schematic illustration of the printing press shown in FIG. 1 and showing in an exaggerated manner thrown on and thrown off positions of the cylinders.

FIG. 3 shows the printing press 10 schematically with the skew eccentrics 38 and 120 omitted and with the locations of various axes displaced from their true location to exaggerate the movement of the linkage and cylinders. Although in a practical embodiment of the invention the actual movement would be much less than shown in FIG. 3, the principle is the same. Upon actuation of the toggle linkage 74, the cylinders move from the position shown in solid to the position shown in phantom in FIG. 3. Any suitable means may be used for this purpose such as an air cylinder or the like. Also, as shown in FIG. 3 a suitable stop 74*a* may be used to limit movement of the linkage and thus position the linkage 74 in the thrown on position. Specifically, plate cylinder 12 moves away from blanket cylinder 14, blanket cylinder 18 moves away from blanket cylinder 14 and plate cylinder 16 moves away from blanket cylinder 18. Only blanket cylinder 14 remains stationary with respect to the side frame members 40, 41 of the press.

Figure 4:
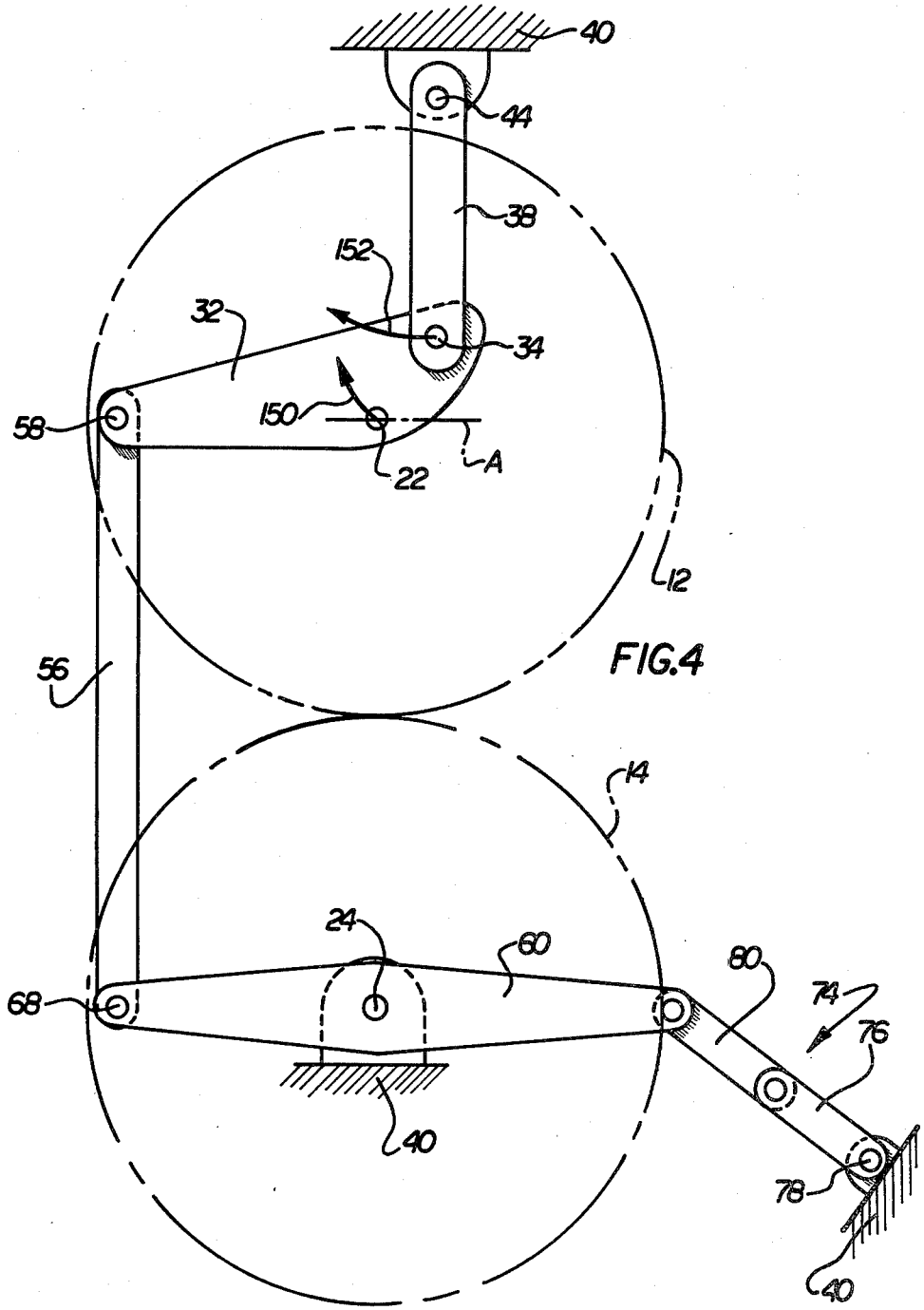
FIG. 4 is a schematic illustration for description purposes of a linkage which is substantially equivalent to a portion of the mechanism of the printing press of FIG. 1.

FIG. 4 is a schematic illustration of the plate cylinder 12, blanket cylinder 14, and the eccentrics 32 and 38 in which the eccentrics have been replaced by their mechanically equivalent links for the purpose of illustrating the operation of the printing press 10. It will be appreciated by those skilled in the art that the lengths of the links shown in FIG. 3 are greatly exaggerated and that in a printing press the eccentric bearing supports would not in fact be replaced with links. Nevertheless, the links of FIG. 4 are illustrative of the principles of the present invention.

As shown in FIG. 4, when toggle mechanism 74 is actuated to cause the link 60 (corresponding to concentric bearing 60) to rotate in a clockwise direction about axis 24, the pin 68 moves upward, and this motion is transmitted through link 56 to the pin 58. The link 38 connecting axes 34 and 44 and representing the skew eccentric, does not move during throw off, and therefore during throw off axis 34 is fixed. Upward movement of link 56 causes the center 22 of the plate cylinder 12 to move upward away from the plate cylinder 14 along an arcuate path indicated by arrow 150, in FIG. 4. This effects throw off of the plate cylinder 12.

When skew adjustment is made, the link 38 (corresponding to skew eccentric 38) is caused to pivot around the axis 44. The axis 34 then travels along an arcuate path centered about axis 44. If the plate cylinder 12 were mounted for rotation about axis 34, the plate cylinder 12 would also move along an arcuate path indicated by arrow 152 upon actuation of the skew eccentric 38. If this were the case, the blanket cylinder and plate cylinder contact pressure would require readjustment whenever a skew adjustment was made.

However, the plate cylinder 12 is made rotatable about an axis 22 which is offset from the axis 34. Moreover, the link 32 (corresponding to throw-off eccentric 32) which is pivotable between axes 34 and 58 and which carries axis 22 (which corresponds to the center of the throw off eccentric 32), is connected to link 56. When the plate and blanket cylinders 12, 14 are thrown on and in contact with each other as shown in FIG. 4, the pin 68 is in the position shown. It can be seen therefore that the plate cylinder 12 is carried on a link 32 which is connected with two other links 38 and 56 which are in turn connected to axes which are fixed with respect to the side frame member 40. Thus, the plate cylinder 12 is in effect carried on a four bar linkage and the movement of link 32 determines the path of movement of the plate cylinder 12.

In a preferred embodiment the lengths of the links 32, 38 and 56 and positions of the axes 22, 24, 34, 44, 58 and 68 have been selected so that the plate cylinder 12 moves along a line which is very nearly tangent to the blanket cylinder 14 when link 38 moves, i.e., when eccentric 38 is rotated. When the axes 22 and 24 are substantially coplanar, i.e., when no skew adjustment has been made, a line connecting centers 44 and 34 is generally parallel with a line connecting the centers of pins 58 and 68. Therefore, upon initial movement of link 38 the plate cylinder 12 moves along a straight line which is perpendicular to the axes of links 38 and 56.

Specifically, when the skew eccentric 38 moves clockwise (link 38 pivots about 44) it tends to cause the clockwise movement of the throw off eccentric 32 and accordingly tends to move the plate cylinder center 22 away from the blanket cylinder center 24. But clockwise movement of the throw off eccentric 32 also causes pivoting of the link 56 about the center of pin 68 in a counterclockwise direction. During such movement, it should be understood that the center of pin 68 is fixed in the frame of the press.

The counterclockwise movement of the link causes rotation of the throw off eccentric in a counterclockwise direction about center 22. Thus, the center 22 of the plate cylinder tends to move along a substantially straight line A (see FIG. 4). Thus, the perimeter of the cylinder 12 moves along a tangent to the blanket cylinder 14.

Of course, if the skew eccentric 38 were moved a large amount, the path of the plate cylinder 12 would not be exactly tangent to the blanket cylinder 14. However, because the amount of movement of the skew eccentric 38 preferably is very small, ordinarily being limited to less than 5° to either side of its center position, the path of the plate cylinder 12 follows the contour of the blanket cylinder 14 sufficiently closely to maintain the adjusted contact pressure between the plate and blanket cylinders without further adjustment being required after making a skew adjustment.

The operation of the linkages supporting the plate cylinder 16 is substantially the same as described for plate cylinder 12 and need not be described further here.

Although the preferred embodiment has been described with the axes of links 56 and 102 being parallel to a plane containing the axes 22 and 24, this is not a strict requirement and the links 56, 102 could form an angle to each other, say, as great as 10° and still substantially maintain the contact pressure adjustment during skew movement of the plate cylinder. Thus, the term "substantially parallel" as used in the specification and the claims which follow includes a deviation of up to 10° from true parallelism.

Thus, it is clear that the present invention provides a printing press 10 (FIG. 1) in which opposite end portions of the plate cylinder 12 are mounted in throw off eccentrics 32 for separating the plate cylinder from the blanket cylinder 14. In addition, one of the throw off eccentrics 32 supporting the plate cylinder 12 is mounted in a skew eccentric 38 so that the plate cylinder may be skewed with respect to the blanket cylinder 14.

The press 10 also includes means for adjusting the contact pressure between the plate and blanket cylinders 12, 14 when they are disposed in contact with each other. The link 56 cooperates with the throw-off eccentric to substantially maintain the preselected contact pressure regardless of how the plate cylinder is skewed. The link 56 causes the throw off eccentric 32 to be rotated by a small amount when the skew eccentric 38 is rotated and in a direction which tends to compensate for the change in contact pressure caused by rotation of the skew eccentric. Specifically, the link 56 rotates the throw off eccentric 32 in response to movement of the skew eccentric 38 to cause the plate cylinder 12 to travel along a path which is approximately tangent to the blanket cylinder 14. In the absence of such the plate cylinder 12 would travel along a path which is concave away from the plate cylinder 14. Thus, such movement of the skewing eccentric would cause substantial changes in the contact pressure adjustment. The present invention minimizes movement of the plate cylinder 12 away from the blanket cylinder 14 upon actuation of the skew eccentric 38 to an extent sufficient to make readjustment of the contact pressure unnecesary upon actuation of the skew eccentric.

FIGS. 5 through 8 show modified embodiments of the present invention all of which have at least one plate cylinder having a pair of eccentrics located at one axial end as in the embodiment of FIG. 1. One of the eccentrics functions as the skew eccentric and the other functions as a throw-off eccentric. The embodiments of FIGS. 5-8 differ from the embodiment of FIG. 1 primarily in the way the throw-off eccentric is actuated and/or which cylinders are thrown off.

Figure 5:
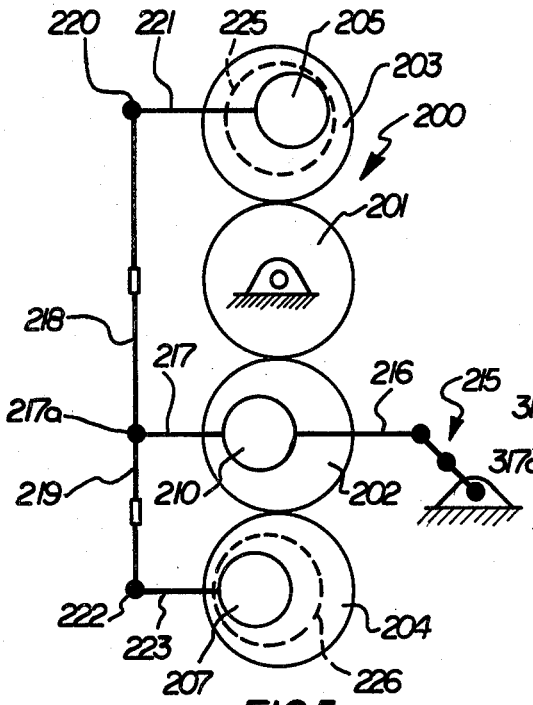
FIGS. 5–8 each show schematically other embodiments of the present invention.

For example, FIG. 5 illustrates a press designated 200. The press 200 includes an upper blanket cylinder 201 and a lower blanket cylinder 202. A plate cylinder 203 cooperates with the upper blanket cylinder 201 and a plate cylinder 204 cooperates with the lower blanket cylinder 202. As schematically shown in FIG. 5, the axis of the upper blanket cylinder 201 is fixed in the press frame.

The upper plate cylinder 203 is thrown off the upper blanket cylinder 201 upon rotation of an eccentric 205 associated with the plate cylinder 203. The lower plate cylinder 204 may be thrown off the lower blanket cylinder 202 upon rotation of an eccentric 207 associated with the lower plate cylinder 204. Also, the blanket cylinder 202 may be thrown off the blanket cylinder 201 upon rotation of an eccentric 210 associated with the lower blanket cylinder 202. The various throw-off eccentrics 205, 207 and 210 are actuated by a toggle linkage generally designated 215.

The toggle linkage 215 is pivotally connected to a link 216 which is fixed to the eccentric 210. A second link 217 is fixed to the eccentric 210 and is pivotally attached at 217*a* to a vertically extending link 218 and a second vertically extending link 219. The link 218 is pivotally connected at 220 to a link 221. The link 221 in turn is fixedly connected to the eccentric 205. The link 219 is pivotally connected at 222 to a link 223 which in turn is fixedly connected to the eccentric 207.

The links 218, 219 lie in a plane which is substantially parallel to the plane containing the axes of the various cylinders. Upon actuation of the toggle linkage 215 the various eccentrics are rotated to cause throw-off of the various cylinders from each other through operation of the links.

A suitable skew eccentric 225 is associated with the upper plate cylinder 203 and the throw-off eccentric 205, as the corresponding eccentrics in the FIG. 1 embodiment. Also, a suitable skew eccentric 226 is associated with the throw-off eccentric 207, as the corresponding eccentrics in the FIG. 1 embodiment, associated with one end of the lower plate cylinder 204.

When the skew eccentrics 225, 226 are actuated the throw-off eccentrics 205, 207 and the linkage cooperate in order to effect a compensating action so that the pressure between the plate cylinders 203, 204 and the respective blanket cylinders 201, 202 remains substantially unchanged, as disclosed above in connection with the embodiment of FIG. 1. Specifically, when either skew eccentric 225 or 226 is rotated, link 218 or 219 is pivoted about pivot point 217*a* (which is fixed relative to the press frame at that time) to thus rotate the respective throw-off eccentric 205, 207 in a compensating direction, as described above in connection with FIG. 1.

Figure 6:
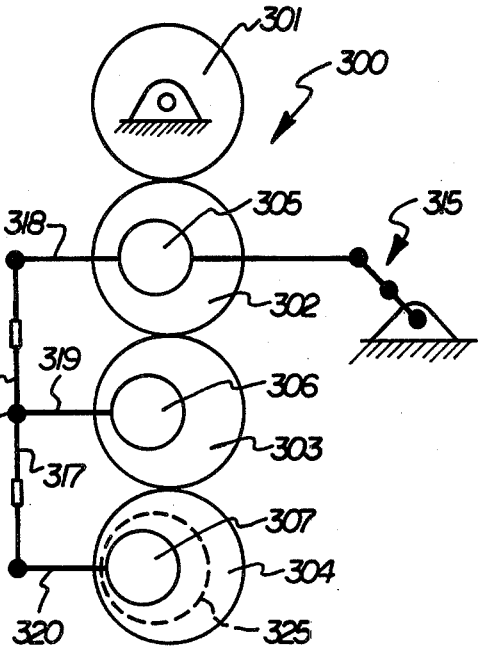

Another embodiment of the present invention is illustrated in FIG. 6. FIG. 6 illustrates a printing press 300 which includes an upper plate cylinder 301, an upper blanket cylinder 302, a lower blanket cylinder 303 and a lower plate cylinder 304. In this embodiment, the upper plate cylinder 301 has its axis fixed in the frame of the press.

In the embodiment of FIG. 6, the upper blanket cylinder 302, the lower blanket cylinder 303 and the lower plate cylinder 304 are all provided with throw-off eccentrics 305, 306 and 307, respectively, to effect throw-off of the cylinders. The throw-off eccentrics are actuated by a suitable linkage which includes a toggle link 315. The linkage also includes links 316 and 317 which are pivotally connected to each other at pivot 317*a*. The link 316 is also pivotally connected to a link 318 which in turn is fixedly connected to the skew eccentric 305 for the upper blanket cylinder 302. Also, the link 316 is pivotally connected to link 319 which in turn is fixedly attached to the eccentric 306 for the lower blanket cylinder 303. The link 317 is pivotally connected to a link 320 which in turn is fixedly connected to the throw-off eccentric 307 for the lower plate cylinder 304. Upon actuation of the toggle linkage 315, the various eccentrics 305, 306 and 307 are actuated to effect movement of the cylinders into throw-off positions where they are not in contact with each other.

In the embodiment of FIG. 6, the upper plate cylinder 301 may be provided with a skew eccentric at one end thereof and which changes the pressure between the plate cylinder 301 and the blanket cylinder 302 upon actuation thereof, as is conventional.

However, the lower plate cylinder 304 is provided with a skew eccentric schematically shown and designated 325. The skew eccentric 325 is associated with the throw-off eccentric 307 in the manner described above in connection with FIG. 1. Thus, upon skew of the lower plate cylinder 304 due to rotation of the skew eccentric 325 the throw-off linkage and the throw-off eccentric 307 cooperate with the skew eccentric 325 to maintain the contact pressure between the blanket cylinder 303 and plate cylinder 304 substantially unchanged when the eccentric 325 is rotated. Specifically, when the skew eccentric 304 is rotated, link 317 will pivot about the pivot point 317*a*, which is then fixed relative to the frame, and will cause rotation of the throw-off eccentric 307 in a compensating direction, as described above in connection with FIG. 1.

Figure 7:
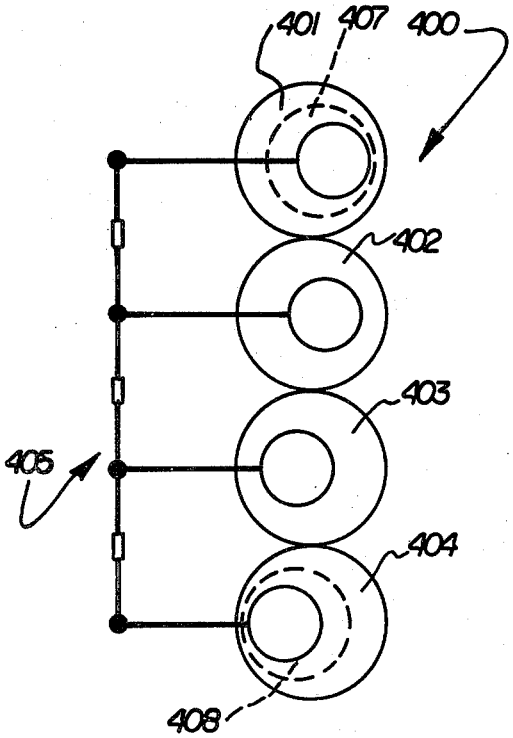

FIG. 7 shows a printing press designated 400 which includes an upper plate cylinder 401, an upper blanket cylinder 402, a lower blanket cylinder 403 and a lower plate cylinder 404. Each of the cylinders has a throw-off eccentric associated with it and a linkage generally designated 405 cooperates with the throw-off eccentrics to cause rotation of the eccentrics when it is desired to throw-off the press. The relative eccentricities of the throw-off eccentrics can be varied in order to vary the amount of throw-off and thereby insure that the various cylinders are located in spaced relationship to each other when the cylinders are thrown-off.

In the embodiment of FIG. 7, the plate cylinders 401 and 404 are provided with skew eccentrics 407, 408 which copperate with the throw-off eccentrics and the linkage 405 in a manner which minimizes the change in the contact pressure between the plate and blanket cylinders when the plate cylinders are skewed, as described above in connection with FIG. 1. Again, the throw-off eccentrics are rotated in a direction to compensate for any change in contact pressure due to pivoting of a portion or link of linkage 405 about a pivot fixed relative to the press frame.

Figure 8:
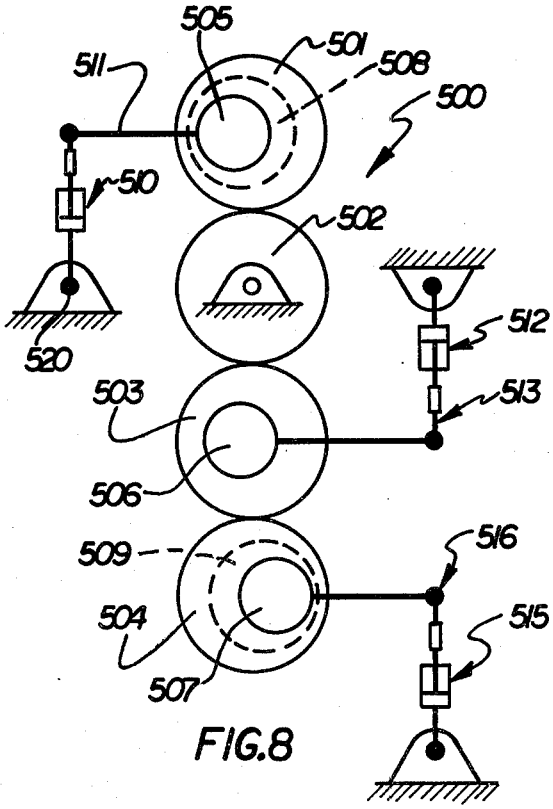

FIG. 8 shows still a further embodiment of the present invention. FIG. 8 schematically shows a printing press 500 which includes an upper plate cylinder 501, an upper blanket cylinder 502, a lower blanket cylinder 503 and a lower plate cylinder 504. In this embodiment the axis of the upper blanket cylinder 502 is fixed in the frame of the press. Throw-off eccentrics 505, 506, 507 are associated with the upper plate cylinder 501, the lower blanket cylinder 503 and the lower plate cylinder 504, respectively. Also, skew eccentrics 508, 509 are associated with the throw-off eccentrics for the plate cylinder 501 and the plate cylinder 504 in a manner as described above in connection with the embodiment of FIG. 1.

The throw-off eccentrics in the embodiment of FIG. 5 are actuated by air cylinders and a suitable linkage. For example, the throw-off eccentric 505 for the plate cylinder 501 is rotated by an air cylinder 510 and an associated linkage 511. The eccentric 506 for the lower blanket cylinder 503 is actuated by an air cylinder 512 and an associated linkage 513. The throw-off eccentric 507 asociated with the lower plate cylinder 504 is actuated by an air cylinder 515 and a linkage 516. The air cylinders 510, 512 and 515 are each pivotally attached to the press frame.

In the embodiment shown in FIG. 8, upon rotation of either skew eccentrics 508 or 509, since the air cylinders 510, 515 are pivotally supported in the frame of the press, the action that was described above in connection with the embodiment of FIG. 1 occurs. Specifically, when the skew eccentric 508 for a plate cylinder 501 is rotated, the air cylinder 510 will pivot relative to the frame about point 520 (which is fixed relative to the frame) and the throw-off eccentric 505 will be rotated to compensate for the rotation of the skew eccentric. Thus, the contact pressure between the plate cylinder 501 and the blanket cylinder 502 will remain substantially unchanged upon rotation of the skew eccentric, as in the manner described above in connection with FIG. 1. Also, the same action occurs when the skew eccentric 509 for cylinder 504 is rotated.

In view of the above, it should be clear that this present application only discloses certain embodiments of the present invention and that many embodiments of the present invention are possible.

What is claimed is:

1. A printing press comprising:

a frame, a plate cylinder mounted in said frame for rotation about a first axis and a blanket cylinder mounted in said frame for rotation about a second axis, said plate cylinder and said blanket cylinder having a contact pressure therebetween for printing operation, skew means supported by said frame associated with at least one end of said plate cylinder and operable to change the relative angular positions of said first and second axes, and means connected with said skew means for maintaining the contact pressure between said plate cylinder and said blanket cylinder substantially unchanged upon operation of said skew means, said skew means comprising a first eccentric means rotatable about a third axis to change said angular position of said first and second axis, and said means for maintaining the contact pressure between said plate cylinder and said blanket cylinder including a second eccentric means for supporting said plate cylinder and associated with said first eccentric means and rotatable relative thereto, and a linkage means connected between said second eccentric means and a point fixed relative to said frame during operation of said skew means for rotating said second eccentric means during operation of said skew means in a direction opposite to the direction of rotation of said first eccentric means to thereby maintain the center-to-center distance between said plate and blanket cylinders substantially unchanged whereby the contact pressure between said plate and blanket cylinders remains substantially unchanged.

2. A printing press as set forth in claim 1 wherein said second eccentric means comprises a throw off eccentric, and said linkage means includes means to effect rotation of said throw off eccentric to thereby throw off said plate cylinder from said blanket cylinder.

3. A printing press as set forth in claim 2 wherein said means for effecting rotation of said throw off eccentric includes a support member pivotally mounted for movement about said second axis, and an actuation mechanism for effecting movement of said support member about said second axis to thereby cause movement of said linkage means to effect rotation of said throw off eccentric.

4. A printing press as set forth in claim 3 wherein said linkage means includes means for adjusting contact pressure between said plate and blanket cylinders when in the thrown on position.

5. A printing press as set forth in claim 4 wherein said means for adjusting contact pressure between said plate and blanket cylinder includes means for adjusting the length of said linkage means.

6. A printing press comprising:

a frame, a plate cylinder mounted in said frame for rotation about a first axis and a blanket cylinder mounted in said frame for rotation about a second axis, said plate cylinder and said blanket cylinder having a contact pressure therebetween for printing operation, skew means supported by said frame associated with at least one end of said plate cylinder and operable to change the relative angular positions of said first and second axes, and means connected with said skew means for maintaining the contact pressure between said plate cylinder and said blanket cylinder substantially unchanged upon operation of said skew means.

7. A printing press as set forth in claim 6 further including throw off means operable to move said plate cylinder into and out of contact with said blanket cylinder.

8. A printing press as set forth in claim 7 wherein said throw off means includes respective eccentrics rotatably supporting opposite axial ends of said plate cylinder, said skew means including a skew eccentric rotatably disposed on at least one end of said plate cylinder and rotatably supporting one of said throw off eccentrics, and said means for maintaining the contact pressure between said plate and blanket cylinders includes linkage means connected at one point with said one throw off eccentric for joint pivoting therewith and at a second point pivotable about an axis which is fixed with respect to said frame when said plate cylinder is skewed.

9. A printing press comprising:

a frame, a plate cylinder and a blanket cylinder mounted for rotation in said frame and having a contact pressure therebetween, skew eccentric means located at one end of said plate cylinder and rotatable to move said plate cylinder between a first position in which the axes of said plate cylinder and said blanket cylinder are parallel and lie in the same plane and a second position in which the axis of said plate cylinder is skewed with respect to the axis of said blanket cylinder, and means connected with said skew eccentric means for maintaining the contact pressure between said plate cylinder and said blanket cylinder substantially unchanged upon operation of said skew eccentric means.

10. A printing press as set forth in claim 9 wherein said means for maintaining the contact pressure between said plate cylinder and said blanket cylinder includes eccentric means rotatable with and relative to said skew eccentric means, and linkage means connected with said eccentric means at one end thereof, said eccentric means supporting a stub shaft extending from said plate cylinder, and said linkage means having its other end fixed relative to said frame when said plate cylinder is skewed.

11. A printing press as set forth in claim 10 wherein said eccentric means comprises a throw off eccentric means, and said linkage means includes means connected with said other end to effect rotation of said throw off eccentric means to thereby throw off said plate cylinder from said blanket cylinder.

12. A printing press as set forth in claim 9 wherein said frame includes a pair of side frame members, said throw off eccentric means including first and second throw off eccentrics supporting opposite end portions of said plate cylinder, said skew eccentric means including a skew eccentric rotatably disposed in one of said side frame members and rotatably supporting said first throw off eccentric, said linkage means including a link having one end portion pivotably connected with said first throw off eccentric and an opposite end portion pivotable about an axis which is fixed with respect to said side frame members when said plate and blanket cylinders are in contact.

13. A printing press as set forth in claim 12 wherein a line connecting the axis of rotation of said skew eccentric in said side frame member and the axis of rotation of said first throw off eccentric in said skew eccentric is substantially parallel to a line connecting said pivotable connection of said link with said first throw off eccentric with said axis about which said opposite end portion of said link pivots when said plate and blanket cylinders are in contact.

* * * * *